United States Patent [19]

Kobayashi

[11] 4,402,162

[45] Sep. 6, 1983

[54] LONG-TRAVEL ANNULAR VIBRATORY BARREL FINISHING APPARATUS FOR LINE-PROCESSING

[75] Inventor: Hisamine Kobayashi, Nagoya, Japan

[73] Assignee: Kabushiki Kaisha Shikishima Chipton, Nagoya, Japan

[21] Appl. No.: 335,667

[22] Filed: Dec. 30, 1981

Related U.S. Application Data

[62] Division of Ser. No. 137,441, Apr. 4, 1980, Pat. No. 4,317,313.

[30] Foreign Application Priority Data

Apr. 9, 1979 [JP] Japan ..... 54-42881
Mar. 5, 1980 [JP] Japan ..... 55-27800

[51] Int. Cl.[3] ..... B24B 31/00
[52] U.S. Cl. ..... 51/163.2
[58] Field of Search ..... 51/163.1, 163.2, 7

[56] References Cited

U.S. PATENT DOCUMENTS 3,771,266 11/1973 Kobayashi ..... 51/163.2
3,975,863 8/1976 Isaacson ..... 51/163.1
4,195,447 4/1980 Walther ..... 51/163.2

*Primary Examiner*—Harold D. Whitehead
*Attorney, Agent, or Firm*—Wenderoth, Lind & Ponack

[57] ABSTRACT

A long-travel annular vibratory barrel finishing apparatus for line-processing having an annular vibratory barrel constituted by at least one barrel line having opposing end barrel segments having a semicircular shape in plan and two straight barrel sections connected between opposing end barrel segments, such that the longer diameter (length) of said annular barrel is much greater than the shorter diameter (breadth) of the same. The annular vibratory barrel as a whole is mounted on a base through a plurality of springs for free vibration which is caused by a vibrator disposed at the center of the longitudinal axis of the annular vibratory barrel. As the vibrator is started, the annular vibratory barrel is vibrated to cause a spiral flow of mass therein. A workpiece transfer device is installed in association with the annular vibratory barrel or, alternatively, workpiece charging device and a workpiece separating device are provided on the annular vibratory barrel, so that successive workpieces are line-processed automatically and continuously. The workpiece transfer device is arranged above the annular vibratory barrel in parallel with the latter, and are adapted to drive spindles carrying workpieces along the barrel while rotating the spindle. A workpiece chucking/unchucking section is provided at a portion of path of the workpiece. The workpiece charging device and the workpiece separating device are disposed in parallel with each other at one end portion of the annular vibratory barrel.

3 Claims, 43 Drawing Figures

LONG-TRAVEL ANNULAR VIBRATORY BARREL FINISHING APPARATUS FOR LINE-PROCESSING

This is a division of application Se. No. 137,441, filed Apr. 4, 1980, now U.S. Pat. No. 4,317,313 issued Mar. 2, 1982.

BACKGROUND OF THE INVENTION

1. Field of the Invention

The present invention relates to a vibratory barrel finishing apparatus and, more particularly, to a long-travel annular vibratory barrel type finishing apparatus for line-processing.

Vibratory barrel finishing apparatuses are broadly divisible into two types: a box-type and a circular-type. The vibratory barrel finishing apparatus of the present invention possesses the advantages inherent in both these two types of apparatus, i.e. adaptability for long line-finishing which is an advantage peculiar to the box-type apparatus and a spiral flow of mass which is an advantage of the circular-type apparatus.

2. Description of the Prior Art

German Patents DBP1047993, DBP1036092 and U.S. Pat. No. 3,071,900, disclose a vibratory finishing apparatus in which the line of the conventional box-type vibratory barrel is extended. In this known apparatus, however, a huge driving means is required for effecting the driving, separation and circulation of mass, resulting in an impractically high cost of production. A circular type apparatus having an extended line is disclosed in Japanese Patent Publication No. 16558/1975, as well as in Japanese Patent Laid-open No. 141995/1978. The length of the extended line, however, is only twice as large as that of the conventional barrel.

The vibratory barrel finishing apparatus disclosed in the Japanese Patent Publication No. 16558/1975 has a vibrator disposed at the center of the vibratory machine body. The finishing barrel has a corner angle which is a right angle or acute angle and has a separating device projecting from the barrel body. Thus, this apparatus has an assymmetrical construction and, therefore, cannot be incorporated in a processing line. It is presumed that this apparatus cannot provide a satisfactory processing effect.

The Japanese Patent Laid-open Publication No. 141995/1978 states that "It makes possible to incorporate not single vibrator but a plurality of vibrator in the space extending along the length of the barrel." Judging from the above-statement, as well as from the attached FIGS. 1-9 and associated description which lacks a consideration of synchronized rotation of unbalanced weights, it is considered that the inventor of this invention has made a serious mistake. Namely, it is known that non-synchronized vibrations of a plurality of vibrators applied to the mass in the barrel causes a random movement of the mass or overflowing of the mass from the barrel. The aforementioned Japanese Patent Laid-open Publication No. 141995/1978 teaches how to overcome the above-mentioned problem by inclining the barrel wall outwardly. This, however, complicates the construction extraordinarily and causes a rise of the cost, as well as suppression of the finishing effect due to an obstruction of flow of the mass.

SUMMARY OF THE INVENTION

It is, therefore, a major object of the invention to overcome the above-described problems of the prior art.

To this end, according to the invention, there is provided a vibratory finishing apparatus having an annular barrel constituted by two or more parallel straight sections and arcuate sections connecting these straight sections at their ends. The straight sections provide the desired length of the finishing line, while the arcuate end sections permit the circulation of the mass.

The movement of the workpiece is performed either by a restraining type system which employs a transfer device disposed along the barrel, or a non-restraining type system in which workpieces are immersed in the finishing media and are given a spiral movement. Thus, the workpiece performs different movements in these two systems which require different kinds of accessories. When the workpiece is comparatively soft and large, it is preferred to use the non-restraining type with an isolating member placed between each two adjacent workpieces.

Thus, according to the invention, an annular vibratory finishing apparatus is constituted by two or more parallel straight barrel segments and arcuate barrel segments which connect the straight segments at their ends, springs by which the annular barrel is mounted on a base for free vibration and a vibrator disposed at the center of the longer axis of the annular barrel.

In the workpiece-restraining type apparatus of the invention, a guide box having a shape similar to that of the annular barrel is disposed above the latter. A rack for rotating the workpieces and a guide for guiding the housing of the spindle chucked workpiece are mounted in the guide box. The housing of the spindle holds the spindle vertically and rotatably, and is provided with a mechanism for raising and lowering the spindle.

In the non-restraining type apparatus of the invention, workpiece charging and discharging sections are disposed above one of the end arcuate barrel segments of the annular vibratory barrel. The workpiece discharge section has a screen for separating the finishin material mass.

In a modification of the non-restraining type apparatus having isolating members, workpiece advance control plates are successively moved in a train so as to posivitely isolate the adjacent workpieces from each other.

BRIEF DESCRIPTION OF THE DRAWINGS

The above and other objects, as well as advantageous features of the invention will become clear from the following description of the preferred embodiments taken in conjunction with the accompanying drawings in which:

FIG. 5*a* is a plan view of the portion of the apparatus shown in FIG. 5*c* near the workpiece charging port;

DESCRIPTION OF THE PREFERRED EMBODIMENTS

Various preferred embodiments of the invention will be described hereinunder with reference to the accompanying drawings.

Figure 1A:
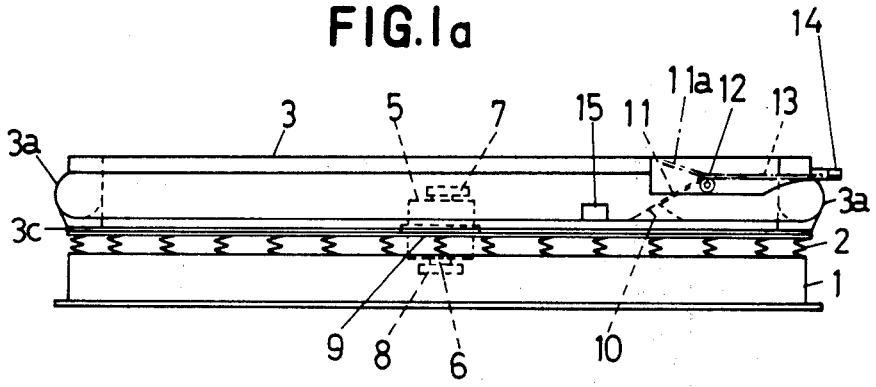
FIG. 1*a* is an elevational view of a non-restraining type line processing vibratory finishing apparatus which is an embodiment of the invention.

A finishing apparatus shown in FIG. 1*a* has a base 1 on which a plurality of springs 2 are disposed at a substantially constant pitch along the central line 4 of the barrel bottom so as to support an annular barrel 3 for free vibration. The barrel 3 has a length L which is several to several tens times, peferably 5 to 15 times as large as the diameter M of opposing semicircular barrel segments 3*a* and 3*a'*. A single vibrator 5 is disposed at the center of the barrel and fixed to a motor-support flange 9 in the central space N of the barrel. Unbalanced weights 7 and 8 are fixed to the upper and lower ends of a vertical shaft 6 of a motor, so that these weights generate vibration as the motor shaft 6 rotates.

Figure 1B:
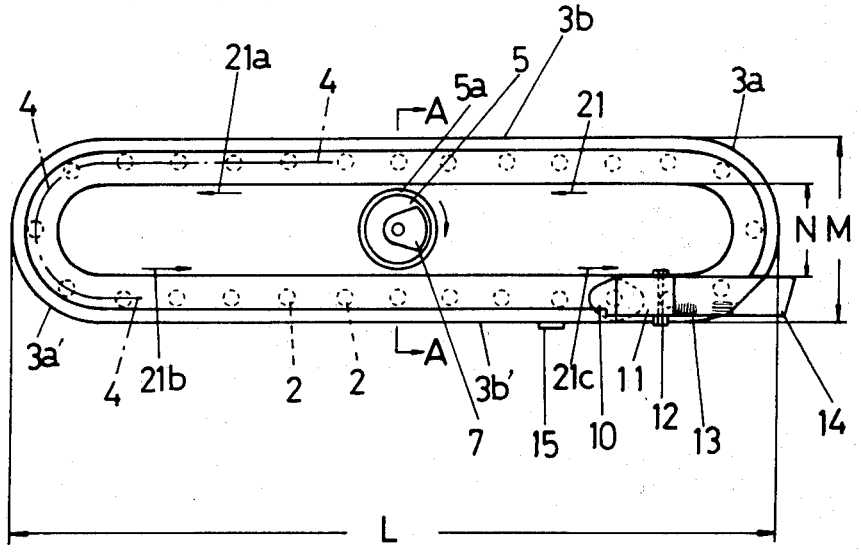
FIG. 1*b* is a plan view of the apparatus in FIG. 1*a*.

For instance, assuming here that the unbalanced weights are rotated clockwise as shown by the arrow in FIG. 1*b*, the mass moves counter-clockwise from the starting end 3*a* of the barrel to 3*b*, 3*a'* and 3*b'*, as denoted by arrows 21, 21*a*, 21*b* and 21*c*. The mass undergoes spiral flowing action in the barrel as shown by the arrow in FIG. 1*c*, from the outer wall to the inner wall of the barrel and vice versa repeatedly, during which the workpieces are finished or polished by finishing or polishing media. Since the elongated annular barrel has a length L which is preferably 5 to 15 times as large as the diameter M of the semcircular barrel, if it is assumed here that the ratio M : L is 1 : 3 to 5, the lead angle of the upper and lower weights are adjusted such that each workpiece completes one circuit in 3 to 10 minutes. The period is 10 to 30 minutes when the ratio M : L is 1 : 5 to 15, and 30 to 60 minutes when the ratio M : L is 1 : 15 to 30. Thus, a multiplicity of workpieces are processed successively in one cycle of operation. Such finishing time or period permits line processing.

An upwardly inclined stationary dam 10 and a rotatable flap shown in FIG. 1*b* closed to the position denoted by numeral 11 or open to the position as denoted by 11*a* in FIG. 1*a*. Namely, the rotatable flap opens and closes as it rotates around the rotary shaft 12 so as to continuously move the mass onto the screen 13 thereby to separate the workpiece from the finishing media. The separated workpiece is conveyed to the outside of the barrel through the discharge port 14 as denoted by the arrow, whereas the separated finishing media which has passed through the screen 13 is recirculated in the barrel for repeating the finishing operation on another workpiece. It is thus possible to continuously process the workpieces in a processing line. It is also possible to open the rotatable flap to the position denoted by 11*a* in FIG. 1*a* to make the workpieces circulate repeatedly to make sure they are completely finished.

Figure 1C:
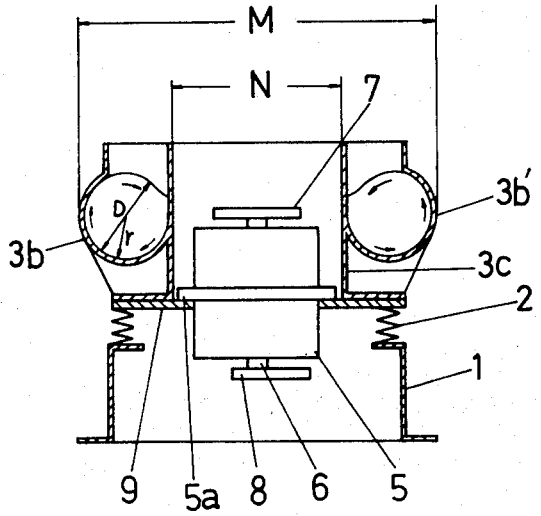
FIG. 1*c* is an enlarged sectional view taken along the line A—A of FIG. 1*b*.
Figure 2A:
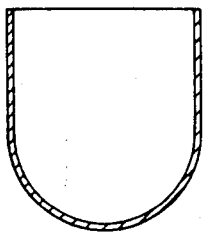
FIGS. 2*a*, 2*b*, 2*c* are sectional views of barrels in accordance with the invention.
Figure 2B:
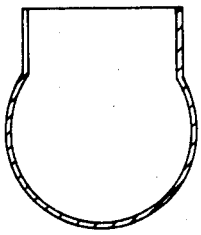
Figure 2C:
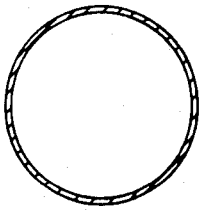

FIG. 1*c* is a sectional view taken along the line A—A of FIG. 1*b*, while FIGS. 2*a*, 2*b* and 2*c* show symmetrical barrels similar to that of FIG. 1 and usable in the finishing apparatus of the invention.

Figure 4A:
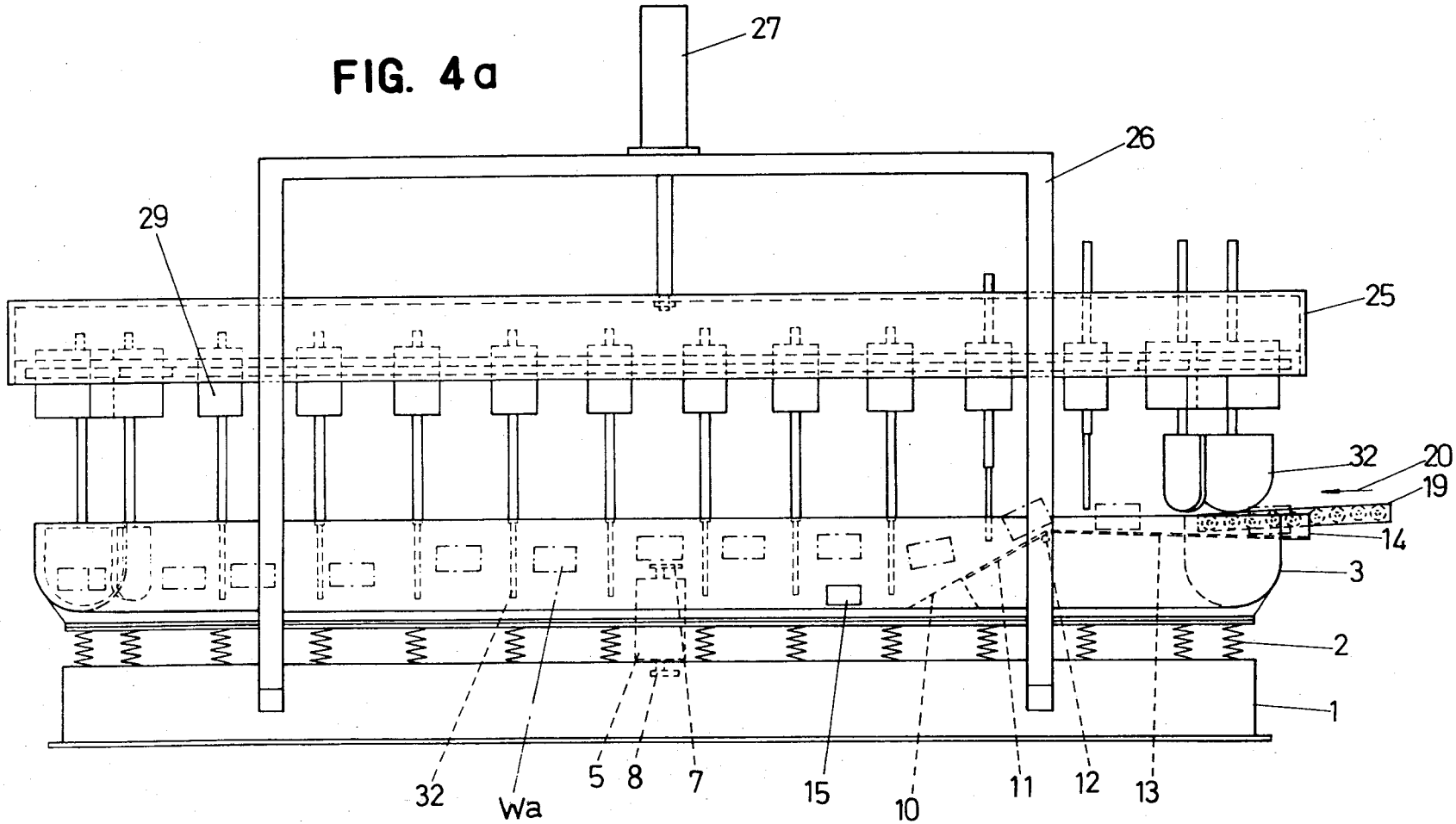
FIG. 4*a* is an elevational view of a line processing long-travel vibratory finishing apparatus having workpiece advancing and controlling plates, constructed in accordance with still another embodiment of the invention.
Figure 4B:
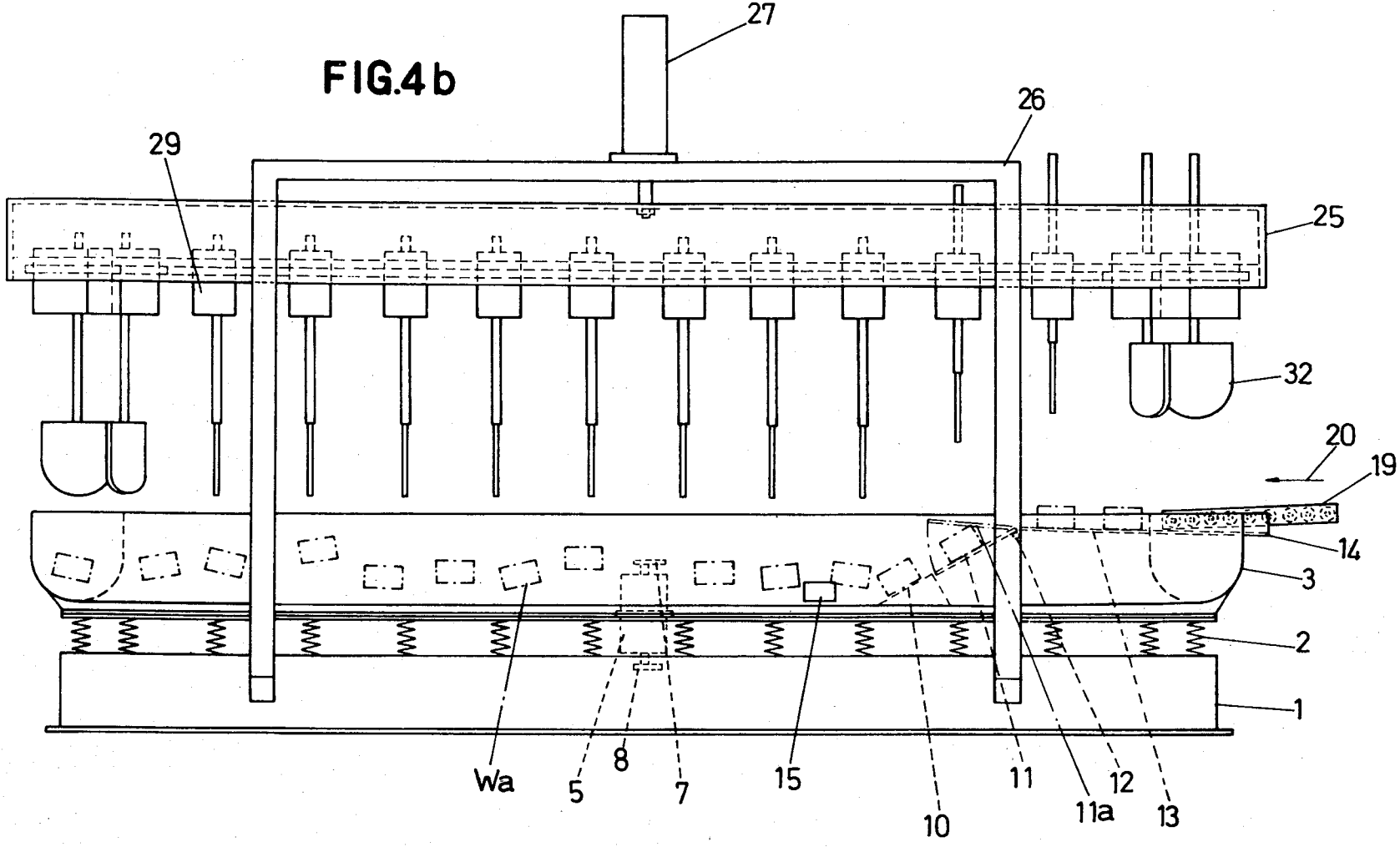
FIG. 4*b* is an elevational view of the apparatus shown in FIG. 4*a* showing the manner of suspending the workpiece advancing and controlling plates.
Figure 4C:
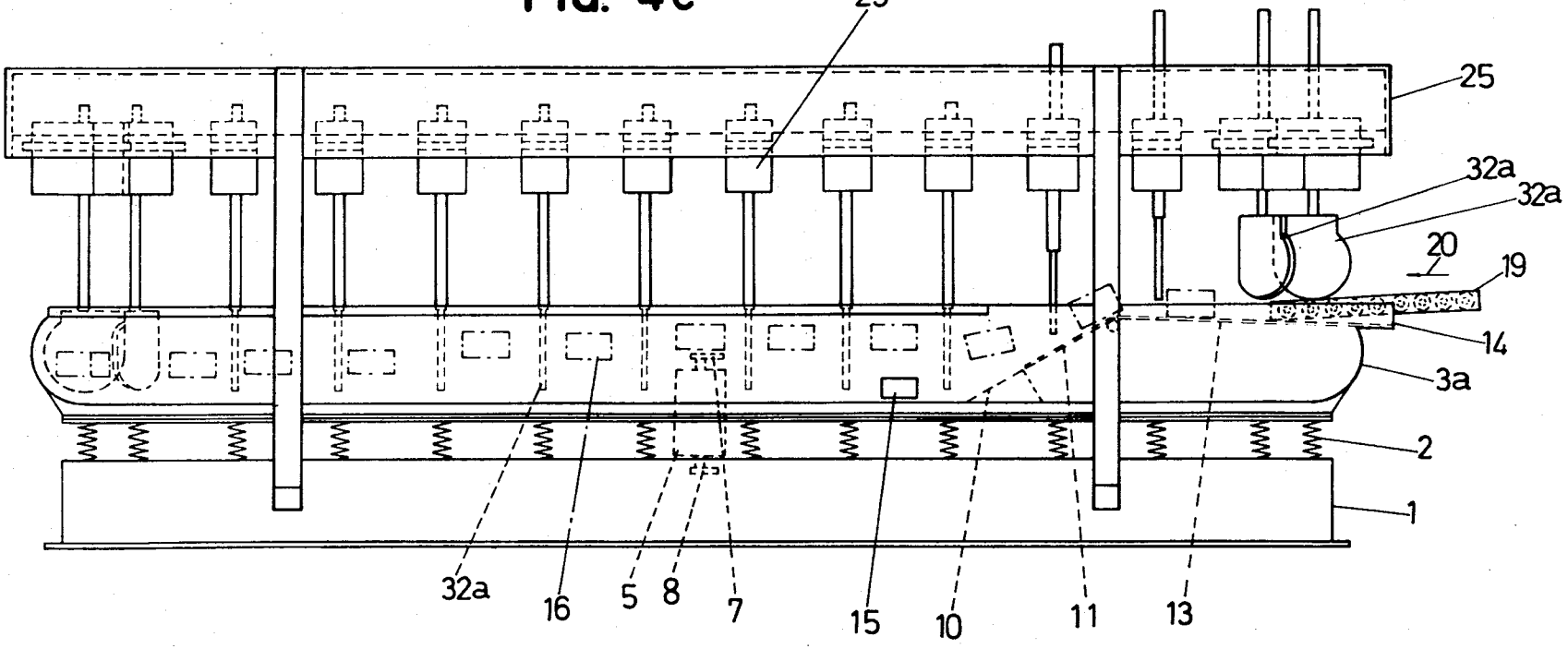
FIG. 4*c* shows a modification in which the inner peripheral surface of the outer wall of the barrel is projected inwardly.
Figure 4D:
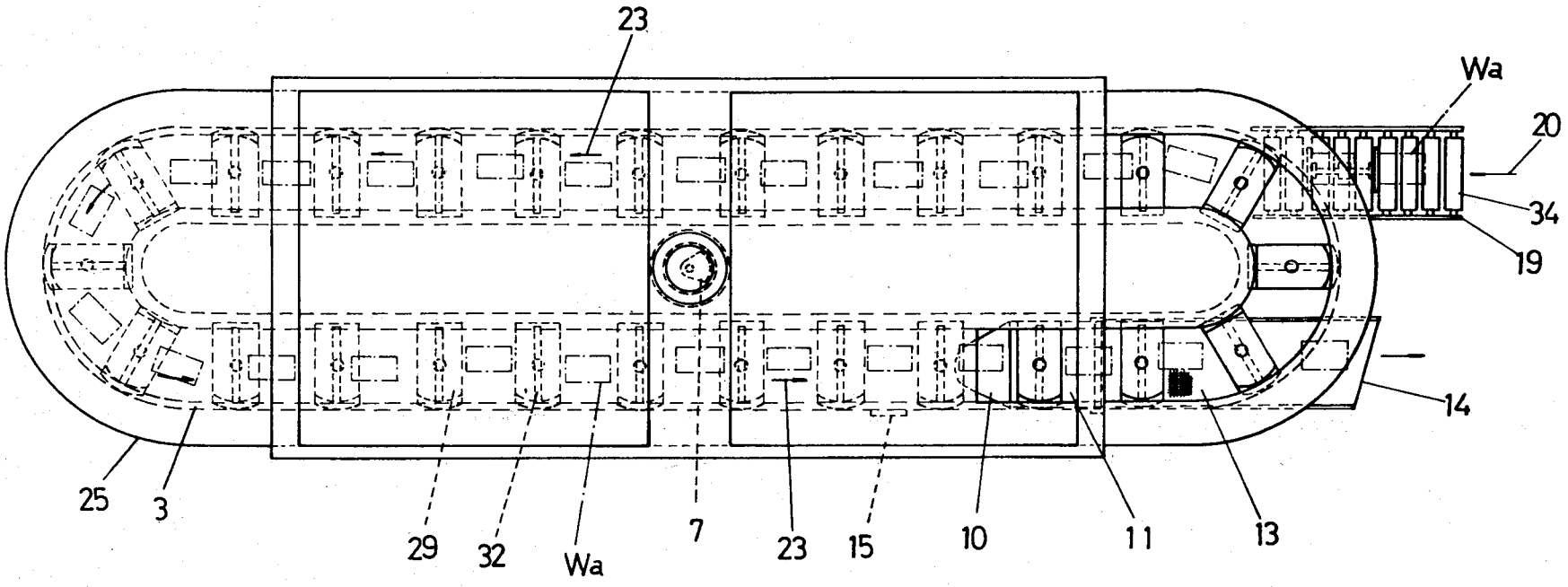
FIG. 4*d* is a plan view of the embodiment shown in FIG. 4*c;*
Figure 5B:
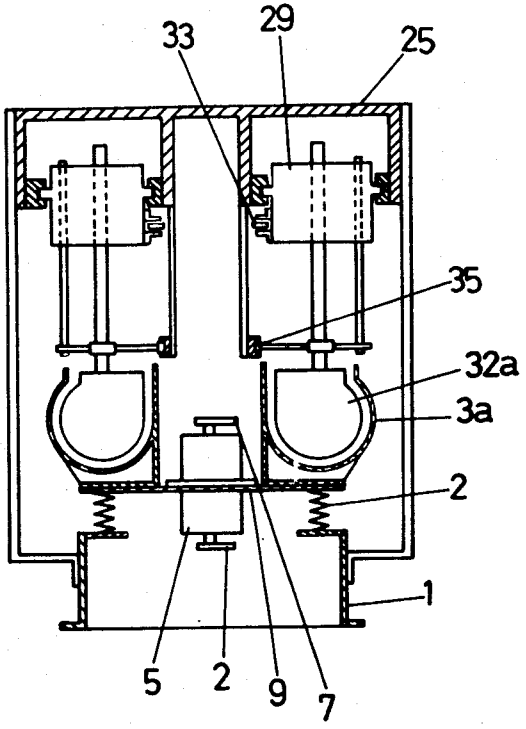
FIG. 5*b* is a longitudinal sectional view of apparatus shown in Fig. 4*c;*
Figure 5A:
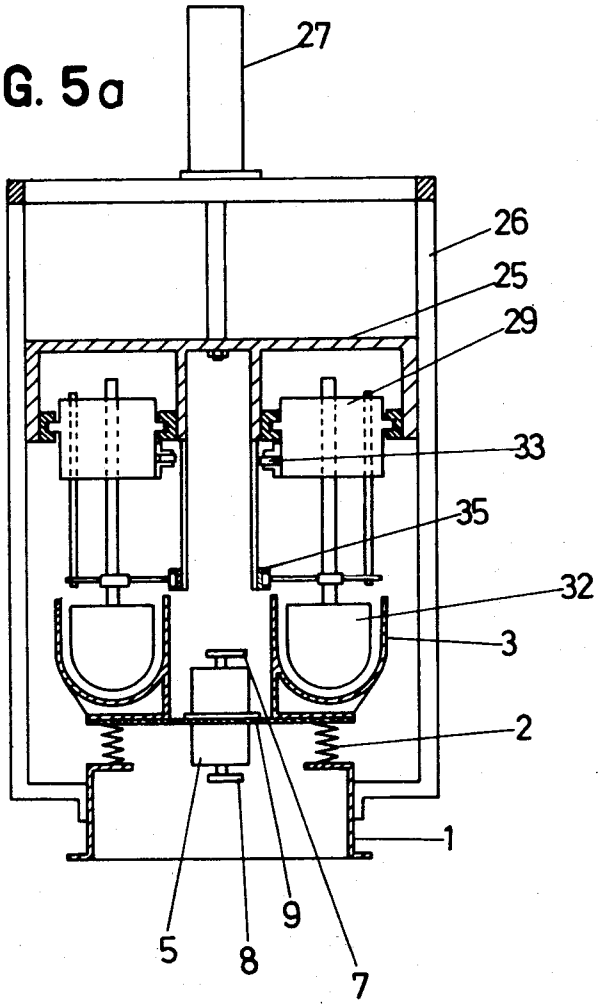
FIG. 5*a* is a longitudinal sectional view of the embodiment shown in FIG. 4*a;*
Figure 5C:
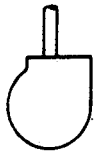
FIGS. 5*c*, 5*d*, 5*e*, 5*f*, 5*g* and 5*h* are illustrations of different forms of control plate.
Figure 5D:
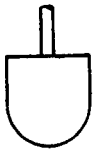
Figure 5E:
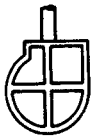
Figure 5F:
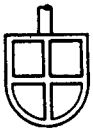
Figure 5G:
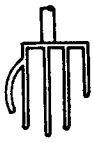
Figure 5H:
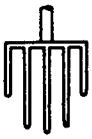
Figure 5I:
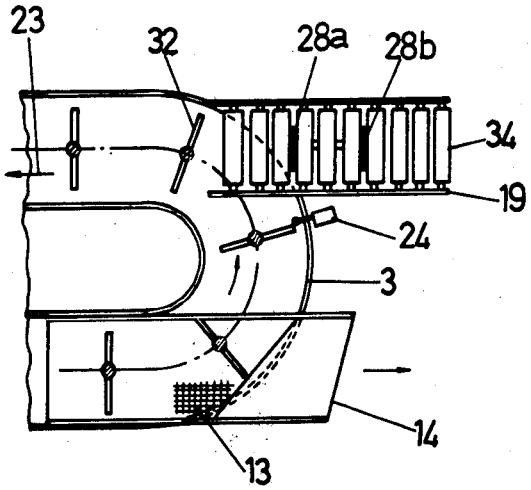
FIGS. 5*j*, 5*k*, and 5*l* are illustrations of the operation of the workpiece charge control device.
FIG. 5*m* is an elevational view of a driving device for controlling plates.
FIG. 5*n* is a plan view of the device shown in FIG. 5*m;*
FIG. 5*o* is a developed view taken along the line C–D of FIG. 5*n;*
Figure 5J:
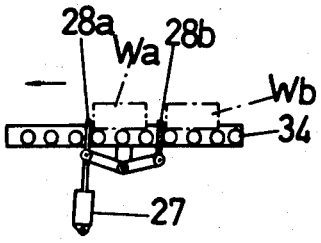
Figure 5M:
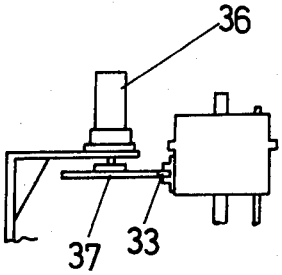
Figure 5K:
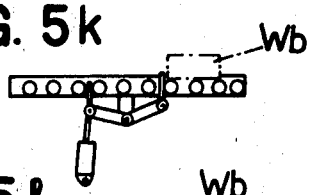
Figure 5L:
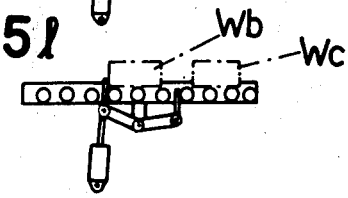

The barrels shown in FIGS. 2*a* and 2*b* have cross-sections which open at their upper portions, while FIG. 2*c* shows a fully-closed barrel. In the latter case, the upper part of the barrel is open at the starting portion (portion corresponding to 3*a* in FIG. 1*b* is open) to constitute the mass charging port. The end portion of the barrel near the starting end, i.e. the portion between 3*b'* and 3*a* in FIG. 1*b* is partly open at its upper side for installation of ing media in the barrel, so that the workpieces are finished as they move within the barrel. In FIG. 4*d*, the arrow 23 represents the direction of spiral flow of the mixture of workpiece and finishing media. This barrel is equipped with an upwardly inclined stationary dam 10, rotatable flap 11, rotary shaft 12, screen 13, workpiece discharge port 14, media discharge port 15 and a workpiece charging port 19 which are known per se. The workpieces Wa are placed through the workpiece charging port 19 in the direction of arrow 20, and are moved successively into the barrel, running over the rollers 34 which are inclined downwardly toward the barrel. More specifically, as will be seen in FIGS. 5*i*, 5*j*, 5*k* and 5*l*, a hydraulic cylinder 27 is actuated as the controlling plate 32 abuts a limit switch 24 so that member 28*a* is lowered to cause the workpiece Wa to move into the barrel and the succeeding workpieces Wb, Wc . . . are moved successively into the barrel as shown by FIGS. 5*j* to 5*l*. The controlling plates 32 drive the successive workpieces along barrel while isolating the adjacent workpieces from each other, so that the undesirable mutual interference between the adjacent workpieces is avoided so as to prevent damage or distortions of the workpieces. Each workpiece is circulated through the barrel as shown by arrow 23 in FIG. 5*i* and automatically discharged through the discharge port 14, so that it is possible to effect line processing on a large number of successive workpieces.

Needless to say, the workpiece advancing and controlling plate has to have a configuration which fits well in the cross-section of the barrel, in order that the plates move smoothly along the inner wall of the barrel. Generally, a U-shaped controlling plate 32 is used in a barrel 3 having a U-shaped cross-section as shown in FIG. 4*a*. Also, a controlling plate having a shape denoted by 32*a* can be used in combination with a barrel 3*a* shown in FIG. 4*c*. In order that the plate 32*a* will clear the wall of the barrel when it is lifted above the latter, the inner surface of the outer wall of the barrel is spread at portions 10, 11, 13 shown in FIG. 4*c*.

In the case of small or medium-size workpieces which do not interfere with each other so that the isolating plates are unneccesary, the guide box 25 is suspended by a hydraulic cylinder 27 disposed at the center of the space between the supports 26 provided at both sides of the central vacant space in the barrel, and the controlling plates 32 and other members are lifted outside of the barrel. The rotatable flap is situated at a position 11*a* and the workpieces are introduced through the charging port 19. As a result, the workpieces undergo spiral movement in the direction of arrow 23 in FIG. 4*d* so as to be circulated for a desired time for a satisfactory finishing.

After the finishing operation, the rotatable flap is reset at the position 11, so that the workpieces are discharged automatically over the screen 13 to the workpiece discharge port 14. It is thus possible to finish a large number of workpieces. If a satisfactory finishing effect is obtained by only one circulation in the barrel, the workpieces are successively line-processed, with the rotatable flap being disposed at the position 11.

Figure 5O:
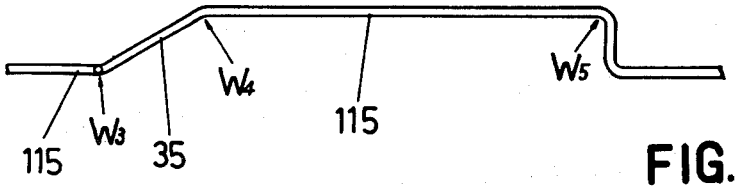
Figure 5N:
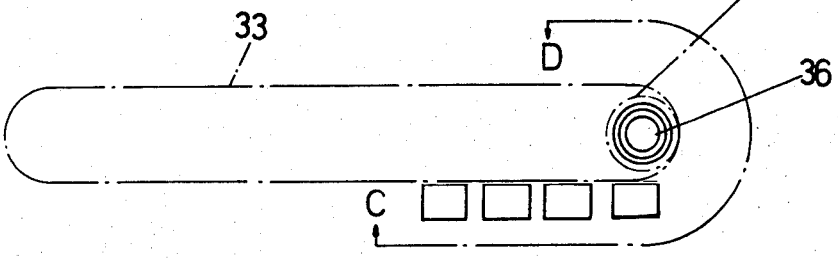

The workpiece advancing and controlling plates 32 are placed in the finishing media as shown in FIG. 4*a* to process the workpieces, and are lifted at a region between positions W3 and W4 of FIG. 5*o* so as to forward the workpieces toward the discharge port. At a position W5, the workpiece advancing and controlling plates 32 are lowered into the finishing media to control the movement of the workpieces charged through the charging port. The controlling plates are adapted to be driven by a chain 33 connected to the control plate shaft housings 29 and engaging a sprocket wheel 37 fixed to the shaft of a driving motor 36. It is possible to locate the vibratory motor at one end of the central open space of the barrel while situating a vibrator at the other end of the central open space of the barrel, the vibrator being adapted to be operated in synchronization with the vibratory motor through a chain or a timing belt which interconnects the vibratory motor and the vibrator. It is also possible to install and synchronously drive 4 to 5 vibrators at one time by a similar method.

Unbalanced weights at a predetermined lead angle and having a predetermined vibration power are fixed to the upper and lower ends of the vertical rotary shafts of the vibrator and the vibratory motor. These rotary shafts are rotated at a speed of 1500 to 1800 r.p.m. in the same direction, thereby to finish the workpieces in the barrel as is known per se.

Figure 6A:
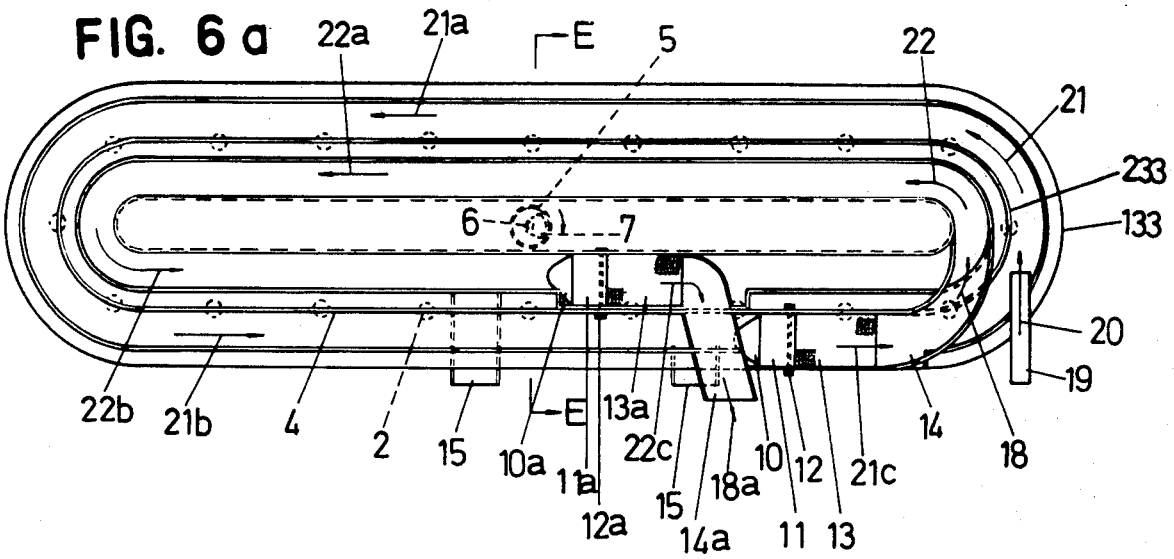
FIG. 6*a* is a plan view of an embodiment of the invention having a plurality of barrels connected in series.
Figure 6B:
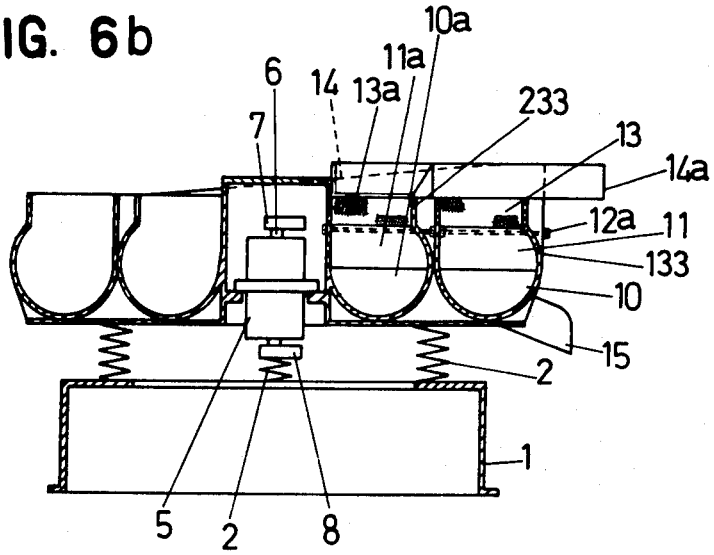
FIG. 6*b* is a sectional side elevational view taken along the line E—E of FIG. 6*a;*

An explanation will be given hereinunder of a different embodiment of the invention in which is provided a plurality of barrels, with specific reference to FIGS. 6*a* and 6*b*. This apparatus has two semicircular barrel segments 133 and 233 at each end between which connected are four straight barrel segments to thereby constitute concentric long-travel annular barrels which together form a barrel structure. On each side of the barrel structure are springs interposed between the barrel structure bottom and the base of the apparatus, along the boundary line between the adjacent barrels, so as to support the whole barrel structure. A single vibratory motor is disposed at the central mid point of the barrel.

Preferably media for rough finishing is charged into the outer barrel 133, whereas the inner barrel 233 is charged with media for fine finishing. The workpiece is introduced first into the outer barrel through the charging port 19 as represented by arrow 20 and flows as denoted by arrows 21, 21*a* and 21*b*. After the rough finishing operation, the workpieces pass over a separating device constituted by an upwardly inclined stationary dam 10, rotatable flap 11, screen 13 and through the workpiece discharge trough 14. The separated rough-finished workpieces are then introduced by trough 14 into the inner barrel 233 as shown by arrow 18. The workpieces then move in the fine finishing media as denoted by arrows 22, 22*a* and 22*b* so as to be finished finely. The workpieces then flow over a separating device constituted by an upwardly stationary dam 10*a*, rotatable flap 11*a*, screen 13*a* and workpiece discharge port 14*a* and are separated from the finishing media as shown by arrow 22*c*. The workpieces then flow out of the barrel as shown by arrow 18*a*. Meanwhile, there is no exchange of finishing media between the inner and outer barrels, so that no mixing of the rough and fine finishing media with each other takes place. Therefore, a multiplicity of workpieces can be subjected first to a rough finishing and then to a fine finishing or first to a wet finishing performed by a wet finishing media with compound solution and then to a dry finishing with a dry media, and are finished at a high rate of one piece per several seconds.

In the event that the workpieces require a long finishing time, the outer and inner barrels can be charged with the same finishing media so that the apparatus is given a doubled barrel length, i.e. a doubled finishing time, making it possible to perform the desired finishing accessories such as the upwardly inclined stationary dam 10, rotatable flap and the screen for the separation. Thus, the cross-sectional shapes of the barrels shown in FIGS. 1*a*, 2*a*, 2*b* and 2*c* are used most appropriately in the annular barrel of the finishing apparatus in accordance with the invention. It will be noted here that any other construction and shape of the barrel such as those shown in the aforementioned Japanese Patent Publication No. 1655/1975 and Japanese Patent Laid-open Publication No. 141995/1978 do not suit the line processing and flowing motion of the mass as performed in the present invention very well. Namely, the barrel of the invention has, along substantially its entire length, a cross-section which is symmetric and contacts the inner side of a circle of equal radius, so that the spiral flow of the mass takes place in quite a smooth manner.

Hereinafter, an explanation will be given as to why the non-synchronous vibration is eliminated in the apparatus of the invention. The barrel of the apparatus of the invention is supported by springs 2 shown in FIGS. 1*a* and 1*b*. The springs 2 should be arranged at equal pitch along the central line 4 of FIG. 1*b* however the annular vibratory barrel may be elongated. In addition, only one motor is fixed at its flange 5*a* to the support 9 at the center and mid-point of the annular barrel. In addition, the unbalanced weights 7 and 8 are fixed to the upper and lower ends of the motor shaft 6 so as to be rotated with a suitable vibratory force and at a suitable lead angle, so that only one way three-dimensional vibration is generated by this vibrator. In consequence, the undesirable non-synchronous vibration is completely eliminated.

There are two types of long box type vibratory barrels heretofore used. One of the conventional systems employs a multiplicity of barrels connected in series, each barrel having one vibrator for generating vibration in a single dimension. The second type employs a plurality of weights for causing one-dimensional vibration connected to a single horizontal shaft or a plurality of shaft segments connected by means of joints, the shafts being disposed at the bottom of the barrel so that the weights are driven in synchronism to cause the vibration. Thus, conventionally, it has been considered that the use of a multiplicity of vibrators is essential even in the case of an annular barrel if the length of barrel is large. The arrangement shown in Japanese Patent Laid-open Publication No. 141995/1978 is based upon this misunderstanding. Namely, the three dimensional vibration is caused to be out of synchronism, unless the unbalanced weights are directed in the same direction and the vibrators are operated in perfect synchronism. Thus, it is quite difficult to obtain one way three-dimensional vibration unless the vibration is caused by only one vibrator.

It is also to be understood that the vibration effect differs considerably between a linear long-distance box-type barrel and an annular long-distance symmetrical barrel.

Figure 3A:
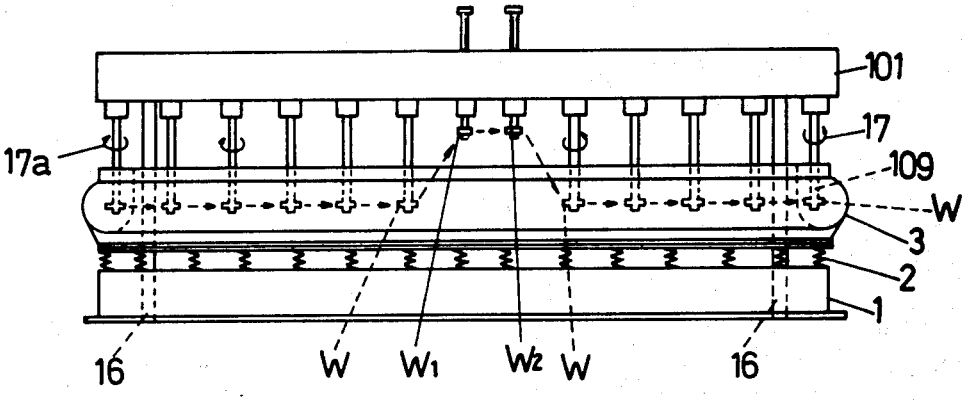
FIG. 3*a* is an elevational view of a workpiece-restraining type line processing vibratory finishing apparatus which is another embodiment of the invention.
Figure 3B:
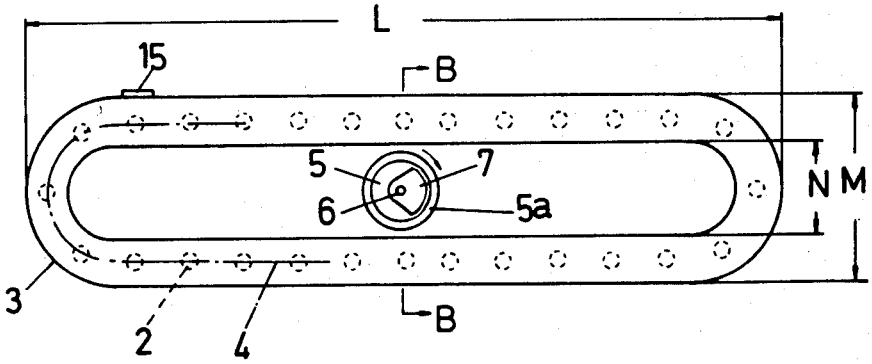
FIG. 3*b* is a plan view showing the positional relationship between the barrel and springs in the apparatus shown in FIG. 3*a;*
Figure 3C:
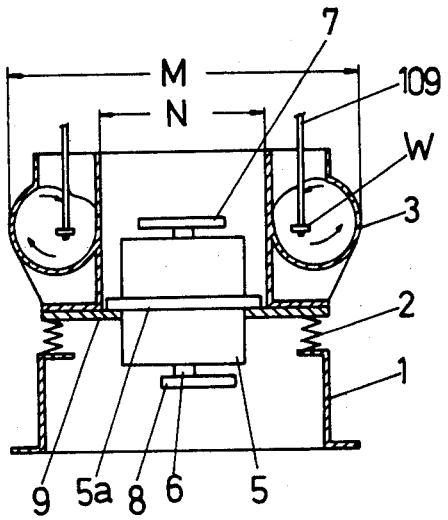
FIG. 3*c* is a sectional view taken along the line B—B of FIG. 3*a* with a part of apparatus removed.
Figure 3D:
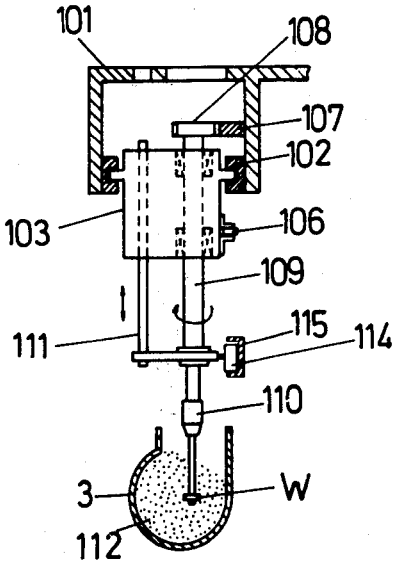
FIG. 3*d* is an illustration of the means for driving of a spindle.
Figure 3F:
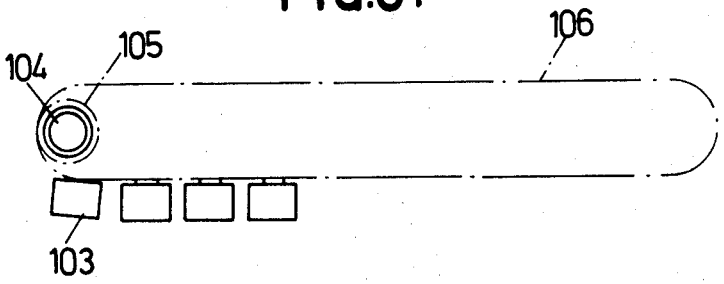
FIGS. 3*e*, 3*f*, 3*g* and 3*h* are exploded views of the housing for the spindle shown in FIG. 3*d;*
Figure 3E:
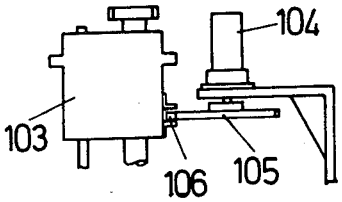

As shown in FIGS. 3*a*, 3*b*, 3*c*, 3*d*, 3*e*, 3*f*, 3*g* and 3*h*, supports 16 are disposed at both ends of the central space of the barrel, and a guide box 101 is mounted on these supports. The guide box 101 accommodates a guide 102 having a groove which slidably receives housings 103 for spindles 109. The housings 103 are connected to a chain 106 which engages a sprocket wheel 105 fixed to the shaft of a driving motor 104. The spindle 109 is attached vertically to the housing 103 for free rotation. A pinion 108 engaged with the rack 107 in the housing is fixed to the upper end of each spindle 109, while a workpiece W to be finished is chucked to the lower end of the spindle by a chuck 110. In FIG. 3*d*, reference numerals 114 denotes a roller for guiding a vertical movement of the spindle 109, 115 denotes a roller guide and 111 denotes a guide rod. Therefore, as the housing 103 is moved by means of the chain 106, the spindle is rotated by engagement of the rack 107 with the pinion 108, so that the workpiece is rotated in the finishing media 112.

The workpiece is rotated in one or the other direction as denoted by arrow 17 or 17*a* of FIG. 3*a*, and is moved in the finishing media as shown by W in FIGS. 3*a* and 3*d*. In the positions W1 and W2, the workpiece is raised so that the finished workpiece can be unchucked from the spindle and a new workpiece to be finished chucked to the spindle 109.

The direction of transfer may be either the forward direction in relation to the spiral movement of the finishing media or may be reverse to the latter. In the latter case, it is possible to effect a heavier processing.

Figure 3G:
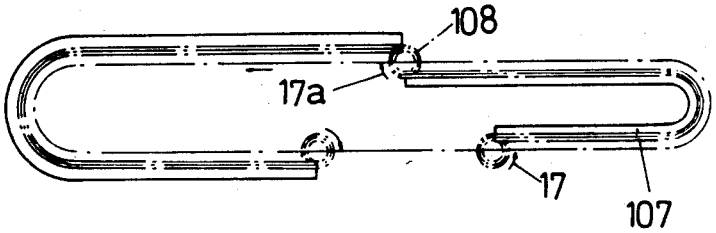
Figure 3H:
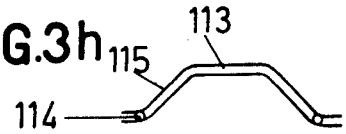

Hereinafter, a description will be given of the chucking and unchucking of the workpiece, with specific reference to FIG. 3*g*. As the spindle 109 and the housing 103 are moved to a workpiece chucking station 113, the spindle 109 stops rotating and a roller rolls upward along the groove of the roller guide thereby to lift the spindle 109 to remove the workpiece W from the finishing media. In the period in which the spindle is held at the same level as the roller guide, i.e. in the period between positions W1 and W2 of FIG. 3*a*, the workpiece W is released from the chuck and a new workpiece to be finished is attached to the chuck instead. Then, the roller guide is lowered to move the new workpiece into the barrel. The pinion of the spindle is again brought into engagement with the rack to cause the rotation of the spindle thereby to carry out the processing in the barrel.

The chucking and unchucking of the workpiece to and from the spindle can be carried out manually or mechanically making use of a combination of a loader and unloader. The rack 107 may be toothed internally over its left half part and externally over its right half part. By so doing, the rotation of the spindle is switched such that while it makes clockwise rotation when the spindle moves along the left half part of the rack, it rotates counter clockwise when it moves along the right half part of the rack, thereby to uniformly finish the workpiece.

FIGS. 4 and 5 show an annular vibratory barrel finishing apparatus which is constructed to permit line processing of a workpiece which is comparatively large and soft and, hence, liable to be damaged or distorted. A guide box 25 is mounted above the upper opening of the annular barrel. The guidebox accommodates control plate shaft housings 29, workpiece advancing and controlling plates 32, driving chain 33 and a roller guide for moving up and down the workpiece advancing and controlling plate. The workpiece advancing and controlling plates conveniently prevents the mutual interference between adjacent workpieces. Referring first to FIG. 4*a* showing this embodiment of the invention in elevation, a vibratory motor 5 is placed at the central mid point of the vibratory barrel 3. Unbalanced weights 7 and 8 are fixed to the upper and lower ends of the vertical shaft of the motor 5. As the motor shaft rotates, one way three-dimensional vibration having no non-synchronous vibration is generated to vibrate the finish-operation in a smaller space than if two separate devices were used. If the workpiece discharge ports of the inner and outer barrels are directed into the barrel, the apparatus can finish two kinds of workpieces with the same or different finishing media.

Figure 7A:
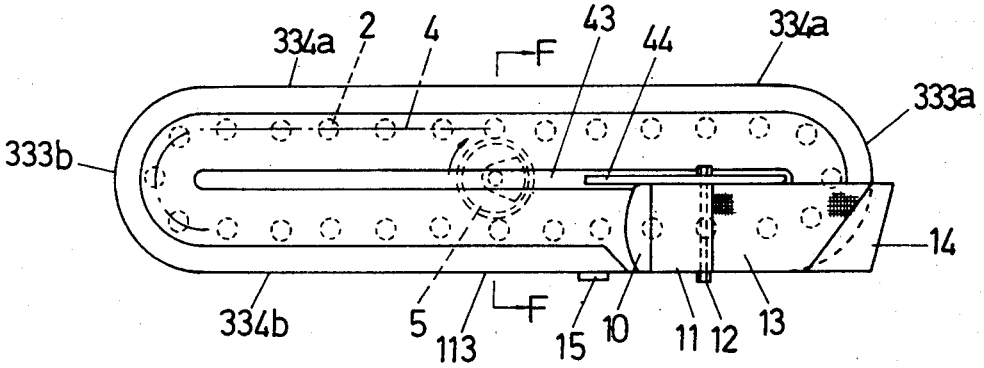
FIG. 7*a* is a plan view of an apparatus embodying the invention in which a vertical side wall is provided at one end of a linear protrusion running along the center of the barrel, and in which an upwardly inclined stationary dam, rotatable flap and a separating device are provided.
Figure 7B:
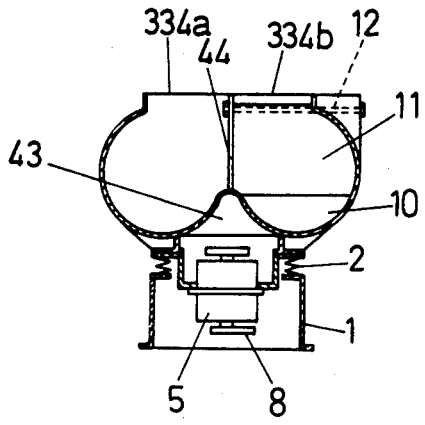
FIG. 7*b* is an enlarged sectional view taken along the line F—F of FIG. 7*a;*
Figure 7C:
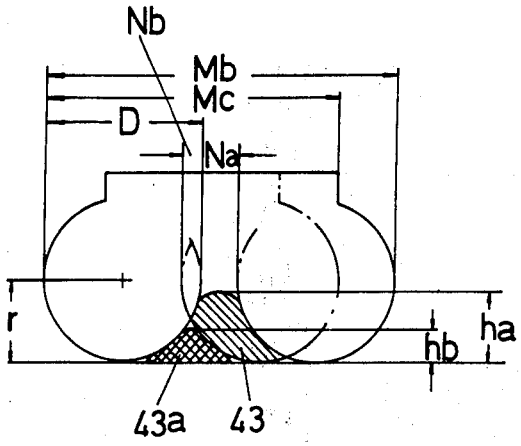
FIG. 7*c* is an illustration of shape and size of the protrusion at the section along the line F—F of 7*a;*

FIG. 7*a* shows a different embodiment in which an elongated barrel is provided with an upward protrusion 43 placed along the center of the elongated barrel. The outer walls of opposing arcuate barrel wall segments 333*a* and 333*b* are unitarily connected by straight barrel wall segments 334*a* and 334*b*. An upward linear protrusion 43 or 43*a* is disposed along the center of the barrel. The cross-section of the barrel transverse to its length has two circular portions, and the surfaces of the protrusion 23 or 23*a* facing the interior of the barrel have a circular profile which are cotinuations of the interior surface of the barrel. The protrusion has a height ha or hb smaller than the radius r of the circular portions on the inside of the cross-section of the barrel, while the distance Na between vertical tangents to continuations of the curvature of the inner walls is substantially less than ⅓ of the barrel diameter D, where said continuations do not intersect, or the distance Nb between the vertical tangents where the continuations intersect is no greater than 1/6 of the barrel diameter D (See FIG. 7*c*). In the barrel having such an elongated shape, the forcible biting of the mass on the inner side of the barrel is avoided to ensure quite a soft and precise line processing. FIG. 7*b* is a sectional view taken along the line F—F of FIG. 7*a*. The vibratory motor 5 is fixed to the center mid point of the barrel bottom.

The line processing as shown in FIGS. 1*a* and 1*b* can be achieved solely by the use of the aforementioned protrusion. It is also possible to modify this embodiment by providing a vertical side wall 44 along one end or along the entire length of the protrusion 43 or 43*a*. In such a case, the separation section for separating the workpieces from the media is constituted by arranging the upwardly inclined stationary dam 10, rotatable flap 11 with shaft 12, screen 13 and workpiece discharge port 14 along this vertical side wall.

It is further possible to obtain a soft and light-load line processing by disposing the workpiece transportation or transfer device as described in connection with FIGS. 3*a*–3*b* over the upper opening of the annular vibratory barrel as described above which has the protrusion 43 or 43*a* therein.

According to the invention, it is possible to use the vibratory motor itself as the vibrator or to drive a single vibrator by two motors for increasing the vibration force. In the case of the annular vibratory barrel having a substantial length as in the invention, however, it is preferred to use only one vibrator in order to obtain a single and sole three dimensional vibration, as is the case with the vibratory motor.

Figure 8A:
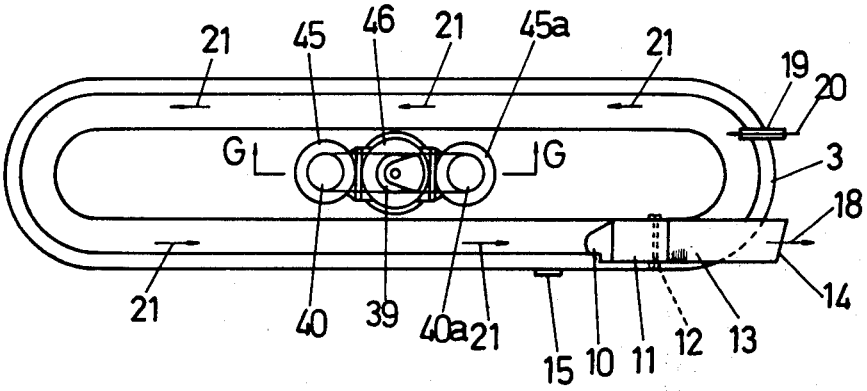
FIG. 8*a* is a plan view of an embodiment of the invention in which a vibrator is driven by a motor.
Figure 8B:
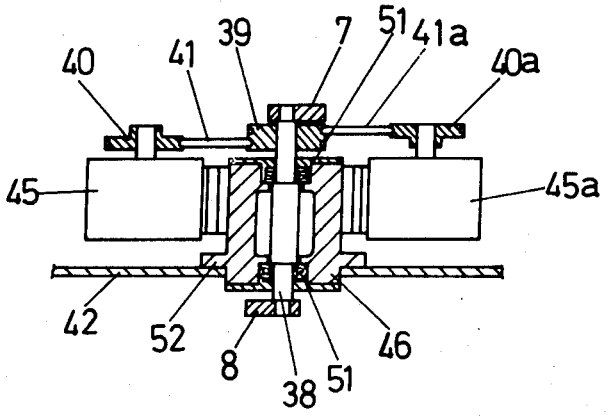
FIG. 8*b* is a sectional view taken along the line G—G of FIG. 8*a;*

In order to meet this requirement, the motors 45 and 45*a* for driving this vibrator are disposed on both sides of the vibrator 46 at an equal distance from the latter, as shown in FIGS. 8*a* and 8*b*, i.e. in symmetry with each other with respect to the vibrator 46, and parallel with parallel straight sections of the barrel. The vibrator or the vibratory motor is placed on the bottom plate 42 at the center of the barrel. The shaft 38 of the vibrator is driven by means of the belts 41, 41*a* which go around the motor pulleys 40, 40*a*. The vibrator 46 is fixed by means of a bracket 52 on the bottom plate 42 which covers the central space of the barrel. Weights 7 and 8 are fixed to the upper and lower ends of the shaft so as to be rotated and to produce the vibration force. Reference numerals 51 denote roller bearings for the shaft. Since seizure of the bearing may be caused if the shaft 38 has a large diameter, it is necessary to use roller bearings for these bearings in place of a spray type lubricaton system. Although the barrel of the apparatus of invention has a large size, it is not always necessary to employ two motors 45 and 45*a*, and the apparatus of the invention can operate satisfactorily with a single vibratory motor if the unbalance caused by the location of the motor and other factors is small.

It is possible to increase the vibration force by disposing a plurality of vibrators along a line extending along the longitudinal center of the long-travel annular vibratory barrel. In this case, a plurality of vibratory motors 45, 45*a* and 45*b* are provided with unbalanced weights 7*a*, 8*a*, 7*b*, 8*b*, 7*c* and 8*c* mounted on the upper and lower ends of the vertical motor shafts at an equal lead angle and for producing an equal vibration force. These weights are directed in the same direction and adapted to be rotated in synchronization. Sprockets 48*a*, 48*b*, 48*c* and 48*d* fixed to the aforementioned plurality of vertical shafts 47*a*, 47*b* and 47*c* are adapted to be driven by chains 50*a* and 50*b* as shown in FIG. 9*c*, or the pulleys are driven through timing belts. In this Figure, $\theta$a, $\theta$b and $\theta$c represent the lead angles of the weights.

Figure 9A:
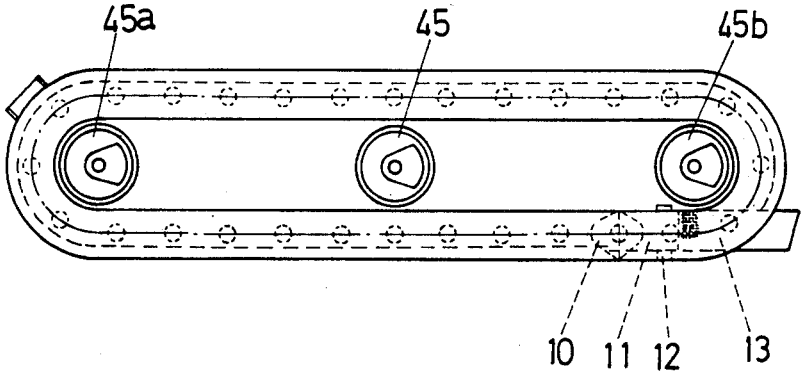
FIG. 9*a* is a plan view of an embodiment of the invention in which a plurality of pairs of vertically unbalanced weights are attached to vertical shafts of a plurality of vibrators and the weights are driven in the same direction in synchronism.
Figure 9B:
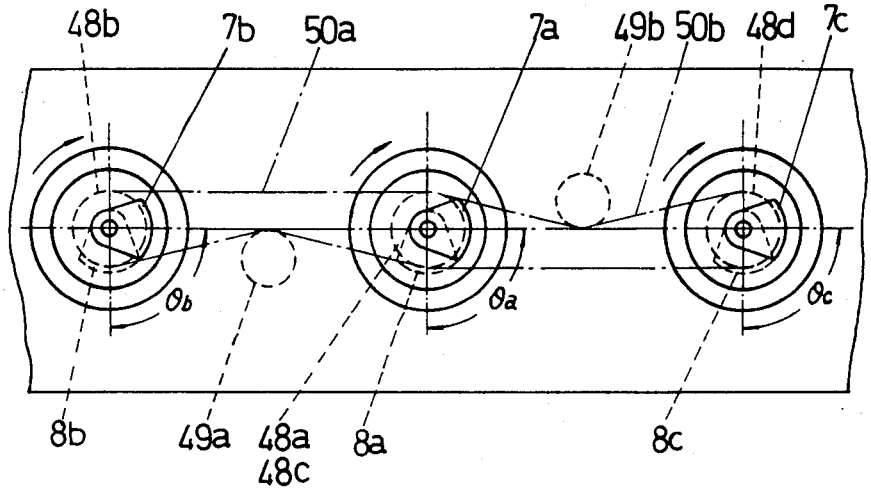
FIG. 9*b* is an enlarged plan view showing a driving device.
Figure 9C:
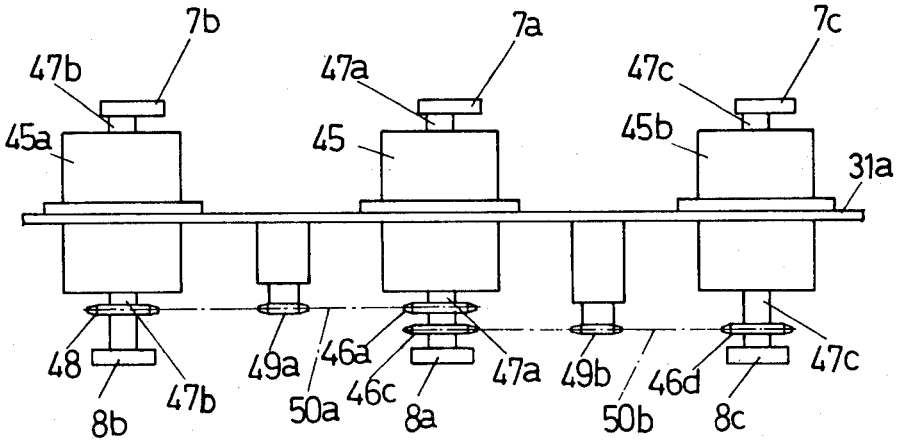
FIG. 9*c* is an enlarged front elevational view of the driving device of FIG. 9*b*.

FIG. 9*a* shows a vibratory barrel finishing apparatus of the invention having three vibrators. Referring to FIG. 9*b*, vibrators 45*a* and 45*b* are disposed on a line on the bottom plate in the central opening of the barrel on opposite sides of a vibratory motor 45 disposed at the center of the barrel. Unbalanced weights 7*a*, 8*a*, 7*b*, 8*b*, 8*c* and 8*c* having a predetermined lead angle and producing a predetermined vibration force are mounted on the upper and lower ends of the vertical shafts of these vibrators. These shafts are provided with sprockets or pulleys 48*a*, 48*b*, 48*c* and 48*d* so as to be rotated in synchronism by means of chains 50*a* and 50*b* or timing belts.

The embodiments and mofifications of the invention heretofore described provide a reasonable, simple and wasteless vibratory barrel finishing apparatus having a long-travel annular barrel suitable for use in line-processing of workpieces. Thus, the invention offers a great advantage that barrel finishing such as grinding can be effectively incorporated in a processing line to remarkably improve the operation efficiency of the line as a whole. In addition, the invention can be embodied in various ways such as finishing by mixing the workpieces with the finishing media or suspension of workpieces in the finishing media. The way of finishing, therefore, can suitably be selected in accordance with the nature of the workpiece.

What is claimed is:

1. A long travel vibratory barrel finishing apparatus for line processing of workpieces to be finished, said vibratory finishing apparatus comprising:

barrel means having two independent concentric elongated vibratory barrels each having two opposed semicircular barrel outer wall segments and straight barrel outer wall segments extending therebetween to form the elongated barrel, each barrel having a cross-section transverse to the length thereof which is symmetrical about the center of the cross-section;

a plurality of springs supporting the bottom of said barrel means and extending along the bottom of the barrel in a line generally parallel to the axes of the circular cross-sectional portion;

a vibrator at the center of said barrel means and having a vertical rotary shaft and having unbalancing weights on the upper and lower ends of said rotary shaft at a predetermined angle to each other around the axis of the shaft for producing a predetermined vibration force on said barrel means during rotation of said shaft;

workpiece and finishing medium removal means in one of said barrels, a screen at the downstream end of said removal means over the interior of said one barrel for separating finishing medium from the workpiece and returning it to said one barrel;

a workpiece conduit means extending from said screen into the other barrel and being the sole means of conveying workpieces from said one barrel to the other barrel; and a further workpiece finishing medium removal means in said other barrel and a further screen at the downstream end of said further removal means.

2. An apparatus as claimed in claim 1 further comprising a further workpiece conduit extending from the downstream end of said further screen for discharging workpieces from said further screen.

3. An apparatus as claimed in claim 2 in which said one barrel is the outer barrel and said other barrel is the inner barrel, and said further workpiece conduit extends outwardly over said outer barrel.

* * * * *